US010195757B2

(12) United States Patent
Carrasco

(10) Patent No.: US 10,195,757 B2
(45) Date of Patent: Feb. 5, 2019

(54) DEVICE WITH A BLADE FOR PROCESSING A PRODUCT

(71) Applicant: A O SCHALLINOX GMBH, Egnach (CH)

(72) Inventor: César Carrasco, Egnach (CH)

(73) Assignee: A O SCHALLINOX GMBH, Schocherswil (CH)

( * ) Notice: Subject to any disclaimer, the term of this patent is extended or adjusted under 35 U.S.C. 154(b) by 179 days.

(21) Appl. No.: 15/124,466

(22) PCT Filed: Mar. 27, 2015

(86) PCT No.: PCT/EP2015/056724

§ 371 (c)(1),
(2) Date: Sep. 8, 2016

(87) PCT Pub. No.: WO2015/150260

PCT Pub. Date: Oct. 8, 2015

(65) Prior Publication Data

US 2017/0015015 A1 Jan. 19, 2017

(30) Foreign Application Priority Data

Apr. 2, 2014 (EP) ..... 14163264

(51) Int. Cl.
*B26D 5/12* (2006.01)
*B26D 5/00* (2006.01)
(Continued)

(52) U.S. Cl.
CPC ..... *B26D 7/086* (2013.01); *B26D 5/005* (2013.01); *B26D 5/086* (2013.01); *B26D 5/12* (2013.01); *B26D 2210/02* (2013.01)

(58) Field of Classification Search
CPC . Y10T 83/8874; Y10T 83/162; Y10T 83/869; Y10T 83/8798; Y10T 83/8801;
(Continued)

(56) References Cited

U.S. PATENT DOCUMENTS 4,513,649 A * 4/1985 Dricot ..... C03B 33/04 83/883
5,163,865 A 11/1992 Smith
(Continued)

FOREIGN PATENT DOCUMENTS

| | | |
|---|---|---|
| DE | 10103740 A1 | 8/2002 |
| EP | 2226172 A1 | 9/2010 |
| EP | 2 551 077 A1 | 1/2013 |

OTHER PUBLICATIONS

Jun. 5, 2015 International Search Report issued in International Patent Application No. PCT/EP2015/056724.
(Continued)

*Primary Examiner* — Phong Nguyen
(74) *Attorney, Agent, or Firm* — Oliff PLC

(57) ABSTRACT

The device, which serves for processing, particularly for cutting and diffusing at least one product, particularly a food product, includes at least one blade that is connectable via at least one coupling member and an energy converter to an ultrasound source and that is fastened to a blade holder, which is connected to a drive device that is held by a framework. According to the invention the drive device includes a plurality of actuators, which are connected each on one side via a first rotary joint to the blade holder and on another side via a second rotary joint in such a way to the framework that the blade holder is held by the actuators alone and is displaceable and optionally turnable within a volume of operation.

21 Claims, 7 Drawing Sheets

Figure 1:
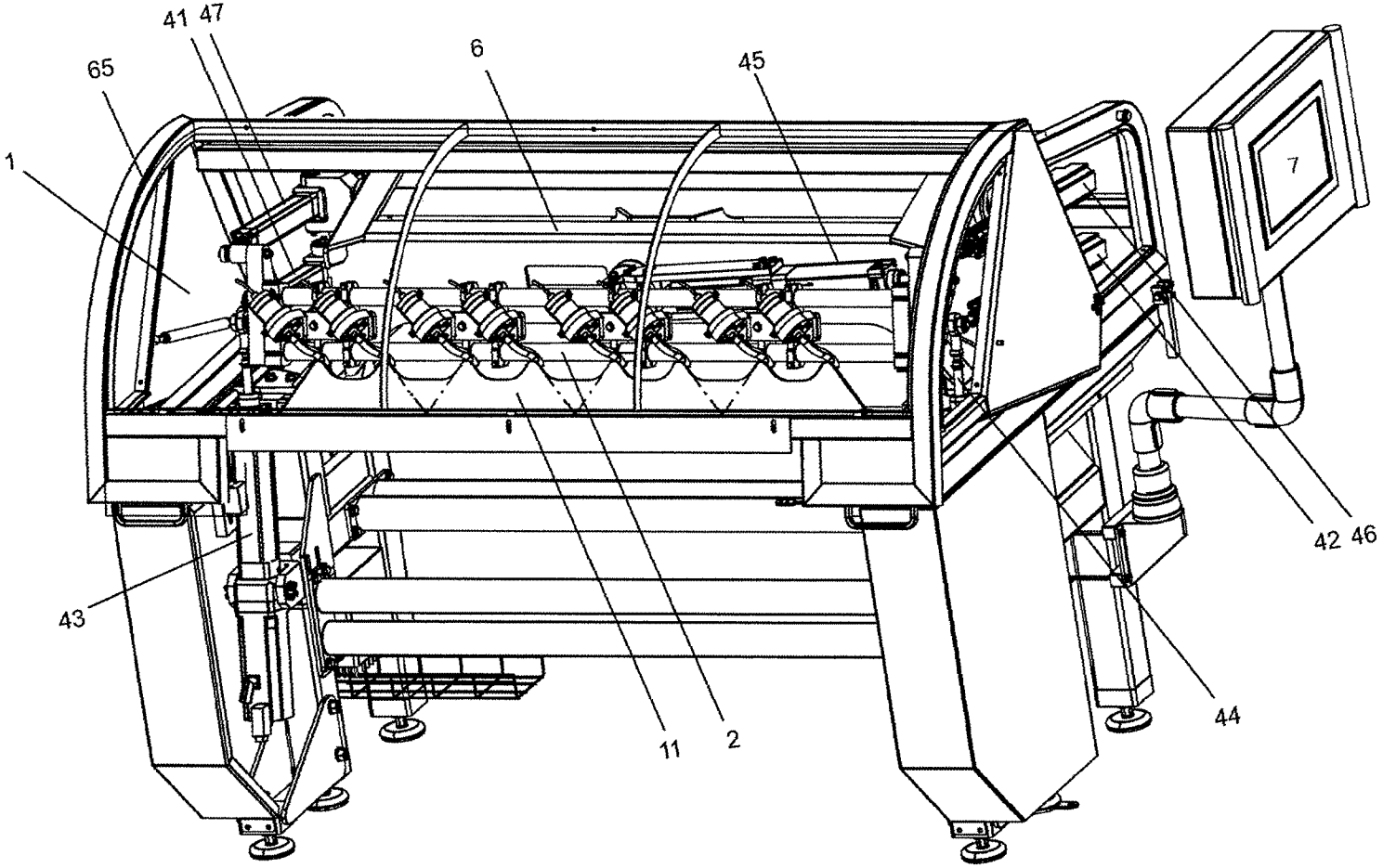

(51) Int. Cl.
*B26D 5/08* (2006.01)
*B26D 7/08* (2006.01)

(58) Field of Classification Search
CPC ..... Y10T 83/8808; Y10T 83/9457; Y10S 83/932; Y10S 83/956; B26D 7/086; B26D 7/26; B26D 7/2614; B26D 7/2628; B26D 5/005; B26D 5/086; B26D 5/12; B26D 5/18; B26D 2210/02
See application file for complete search history.

(56) References Cited

U.S. PATENT DOCUMENTS

| | | | | |
|---|---|---|---|---|
| 5,658,229 | A * | 8/1997 | Armington | B26D 1/30 493/363 |
| 2010/0089878 | A1* | 4/2010 | Halser | B23K 10/00 219/121.39 |
| 2011/0303065 | A1* | 12/2011 | Liu | B27B 5/208 83/471.3 |

OTHER PUBLICATIONS

Jun. 5, 2015 Written Opinion issued in International Patent Application No. PCT/EP2015/056724.

* cited by examiner

DEVICE WITH A BLADE FOR PROCESSING A PRODUCT

The invention relates to a device with a blade used for processing a solid or powdery good, such as meat, cheese, vegetables, bread, pasta or spices.

In numerous industrial applications, particularly in the food industry, products need to be provided with predetermined dimensions. Often, food products, such as bread, sausages or cheese are cut to slices and packed. For this purpose, cutting devices, e.g. devices with rotating circular cutting discs are provided, which are guided with high clock frequencies against the products, in order to execute the required cuts. Such devices are costly in production, operation and maintenance. The rotation of the cutting discs, which need to be grinded regularly, causes a massive impact on the processed good, so that product particles are loosened and thrown away, whereby contamination of the device results.

EP2551077A1 discloses a cutting device with a knife that is connected via a coupling member and an energy converter to an ultrasound generator. The knife is held on both sides in horizontal alignment and is guided during the cutting process within a plane upwards and downwards, in order to cut the processed product. In order to reach a precise cutting line, the processed good is conveyed along a conveyor plane perpendicular to the cutting plane towards the knife. Hence, this cutting device cutting allows cutting a processed product precisely in a conventional manner. However, the properties of the processed products are highly different, so that it would be desirable if parameters of the cutting process could be adapted to the processed product. In this respect, possibilities provided by conventional cutting devices are strongly limited. Special requests by the user cannot be fulfilled, wherefore products offered on the market, such as slices of sausages or bread, exhibit always the same geometrical forms. Furthermore, with this cutting device only products can be processed that are typically forwarded by a conveyor belt.

EP2551077A1 discloses that a blade can also be used for atomising a processed product, wherefore however a device with a blade is required that has a completely different design. Devices of this kind can also advantageously be used in the food industry or in the pharmaceutical industry in order to provide dosages of the powder or to atomise the powder. However, by providing different devices with a blade, which are designed for different application purposes, considerable efforts result in view of providing the devices and space, in which these devices are installed. A high redundancy of installed material and corresponding costs result.

DE10103740A1 discloses a method for cutting at least one line of a food product placed on a conveyor device in an industrial in-line production line by ultrasonic waves. Use of a knife is thereby avoided.

U.S. Pat. No. 5,163,865A discloses a device, with which fillet of fish and other food can be cut into portions of predetermined size. The knife is displaceable in longitudinal direction vertically to the conveying direction. Other cutting options for processing a product are excluded.

EP2226172A1 discloses a deburring device with a knife that is held by an arm of a robot. This device requires a costly robot, with which only small knives can be handled.

The present invention is therefore based on the object of providing an improved device with a blade for processing at least one product, in particularly in the application range of the food industry or the pharmaceutical industry.

In particular, a versatile device with a blade shall be created, with which a product can advantageously be cut and/or atomised.

With this device, methods for processing, particularly for cutting and/or atomising a processed product shall be executable, which are adapted to the requirements of the user, adapted to the processed product, as well as adapted to the adjacent devices. In particular, the device shall be adaptable to devices, which are provided for the transport of the processed product or different products towards or away from the inventive device.

It would be desirable, if further process steps could be executed with the blade allowing for example, precisely dispensing, positioning or accelerating the processed product.

E.g., it shall be possible to cut, atomise and mix different products, which reach the device in different ways.

The device shall have a compact structure and shall require little space, so that it can advantageously be integrated into any production process.

With the inventive device complex application processes shall be executable with high clock cycles.

This object is reached with a device that comprises the features defined in claim 1. Advantageous embodiments of the invention are defined in further claims.

The device, which serves for processing, particularly for cutting and atomising at least one product, particularly a product of the food industry or the pharmaceutical industry, comprises at least one blade that is connectable via at least one coupling member and an energy converter to an ultrasound source and that is fastened to a blade holder, which is connected to a drive device that is held by a framework.

According to the invention the drive device comprises a plurality of actuators, which are connected each on one side via a first rotary joint to the blade holder and on another side via a second rotary joint in such a way to the framework that the blade holder is held by the actuators alone and is displaceable and optionally turnable within a volume of operation. Within the volume of operation the blade can be moved forth and back, downwards and upwards and preferably also to the side.

Hence, the blade holder is not guided as usual on rails along a single cutting plane, but is displaceable or positionable by the actuators within a volume of operation in a selected alignment along at least one selected straight or curved cutting area.

Controlling the actuators correspondingly, allows guiding the blade aligned and positioned arbitrarily within the volume of operation. Thereby the blade can be guided forth and back between two or more cutting areas in order to execute cuts on different products, whereby the resulting product can also be a mixture of the different products. Alternatively or in addition the blade can be horizontally aligned and be provided with a powdery product, which then is evenly atomised, e.g. in order to flavour the mixture of the processed product. Hence, with the device a ready-made menu can be assembled from different products. E.g., different sorts of dried meat can be cut, mixed and flavoured. Thereby a first sort of dried meat can be cut, evenly flavoured with a first sort of powdery spices and then be covered by a processed product such as a second sort of dried meat.

The cutting area can have the form of a wave, so that product exhibiting a waveform is produced, which has a favourable look, can easily be grasped and can be placed with higher density into a smaller volume.

Due to its agility the blade can not only cut but also displace the processed product. E.g., the processed product is cut and mixed on a plate. Subsequently the blade can be moved down onto the plate and together with the processed product or the mixture along the plate to a container. With the blade a product can also be grasped and moved, before it is processed. Hence, the inventive device can process and influence the product not only in a main process, but also in a preceding and a succeeding process.

For example, cakes or bread can be cut to desired dimensions and then be provided with cuts or slices, into which for example a powdery product is floured.

By corresponding selection of the actuators the size of the volume of operation can be determined. In preferred embodiments cylindrical actuators or linear drives are provided, which comprise an axially displaceable piston rod. By selecting the actuators, particularly the length and the alignment of the piston rod, the executable movements and turnings of the blade can be determined. It can be arranged for example that the blade can be moved in two or three directions forth and back and can be turned at least around one axis, preferably the axis of the blade. Thereby a blade can be provided, that comprises a cutting edge on both sides and that can therefore execute in both directions of movement a cut into a first or a second product. The use of a blade with two cutting edges doubles the operating capacity not only in one plane but within the whole volume of operation.

Controlling the actuators is done by means of a control program provided in a control unit. In preferred embodiments, all actuators are individually controllable. Depending on the executed movement several actuators can also be controlled identically. If the blade is merely displaced in parallel and is kept in the same alignment, then the actuators, which are aligned in parallel to the direction of movement, are controlled identically. By controlling the actuators differently the blade can be tilted or turned around its longitudinal axis or around further axes.

In a preferred embodiment, a first and a third actuator, which preferably enclose an angle of 90°, are connected each via a corresponding one of the first rotary joints to the first side of the blade holder. Further, a second and a fourth actuator, which enclose an angle of preferably 90°, are connected each via a corresponding one of the first rotary joints to the second side of the blade holder. E.g., the actuators are coupled to side plates provided at both ends of the blade holder. By operating the actuators the side plates, which are faced each by one end of the blade, can be moved in parallel to one another or independently from one another in a plane. If the side plates are moved in parallel to one another, then the blade is always held horizontally aligned. By differently controlling the actuators a geometrical form of a double cone (Diabolo) can be drawn, whereby the cones can exhibit different sizes and can be inclined. Hence, the blade can be displaced along the transporting direction of the processed product or along the transporting directions of the products forth and back as well as perpendicular thereto and preferably can be turned around at least one axis extending perpendicular to the longitudinal axis of the blade. Hence, the blade can be moved into different operating positions and can execute a vertical movement or a cut through a product in each one of these operating positions.

In a further preferred embodiment, a fifth actuator is provided, which is aligned inclined or perpendicular to the longitudinal axis of the blade and preferably is aligned in parallel to the first and second actuators and is connected via a corresponding one of the first rotary joints to the blade holder, so that the blade can be turned around its longitudinal axis or can be stabilised in a selected angle of rotation. Hence, by evenly actuating the first three actuators the blade is moved forward and backward without being turned. If the third actuator is accelerated more or less, then a turning of the blade around the longitudinal axis is executed, whereby the product can be cut or a cut product can be displaced on the support tray. Further, the blade be aligned in a horizontal plane, so that a powdery product can be placed thereon and can be transported and atomised by vibrations and the impact of ultrasound.

In a particularly preferred embodiment, a sixth actuator is provided that is aligned with one vector component in parallel to the blade and is connected via a corresponding one of the first rotary joints to the blade holder, so that the blade is displaceable along its longitudinal axis. With the sixth actuator a lateral cutting movement can simultaneously be executed while the blade is displaced downwards, in order to divide the product even more easily and to avoid any compression of the product. By the sixth actuator, a lateral movement e.g. in form of a sinusoidal oscillation can be superimposed onto the vertical movement of the blade. E.g., an oscillation in the frequency range of 1 Hz-10 Hz is provided, wherefore the control unit applies corresponding control signals to the sixth actuator.

The rotary joints can identically or differently be designed and are selected according to the movements that shall be executed by the actuators. The first rotary joints, which are connected to the blade holder, are for example swivel joints, hinge joints, fork joints, angle joints or combinations thereof which exhibit two joint functions. The second rotary joints, which are connected to the framework, are preferably swivel joints, hinge joints, fork joints, angle joints or combinations thereof which exhibit two joint functions.

The actuators can electrically, hydraulically or pneumatically be driven, whereby combinations thereof are possible. Piston rods of electrically driven actuators can precisely be driven out. The piston rod is coupled for example with a spindle that can be turned by means of a step motor by a number of turns, which corresponds to the required swing.

The blade holder preferably comprises two side plates, which are connected by at least one crossbar and on which preferably the first rotary joints are mounted. At the crossbar the energy converters are mounted preferably pairwise by means of mounting devices.

The coupling members, which connect the energy converter to the blade, are preferably curved and connected, preferably welded on the front side or back side of the blade to the blade back.

In a preferred embodiment a unitary blade is provided, which in even distances is connected to a plurality of coupling members, so that ultrasonic energy can evenly be coupled into the blade and can act along the cutting edge or the cutting edges with even intensity.

Although the blade can execute almost any movements within the volume of operation and the inventive device can universally be used, the device still has relatively small dimensions. In this way the device can easily be integrated into a production line.

The inventive device can also advantageously be integrated into an already installed production line that comprises anchoring points on which the second rotary joints can be mounted. In this way production lines already in operation can advantageously be equipped with further functions for processing a product.

Figure 2A:
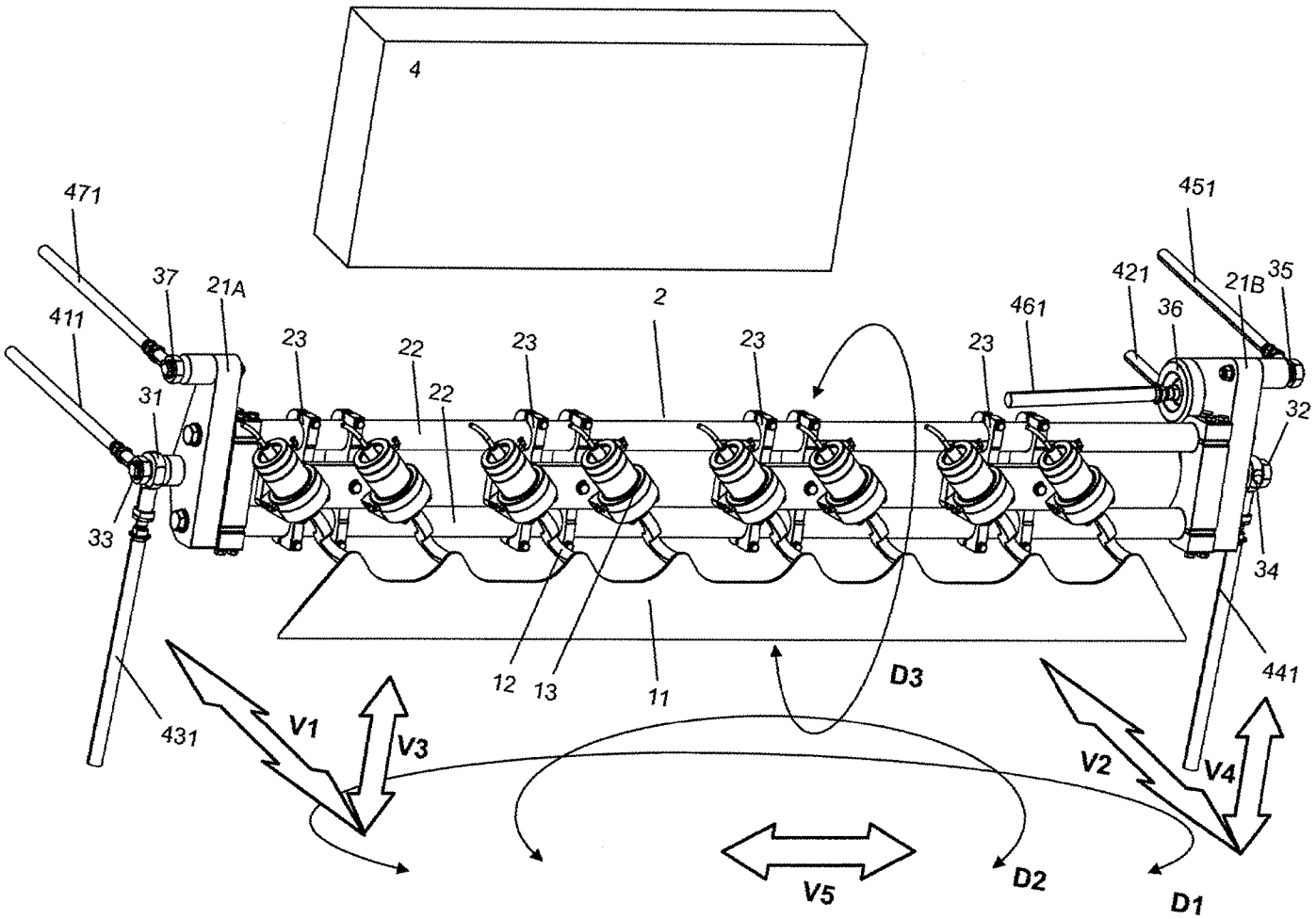
Figure 2B:
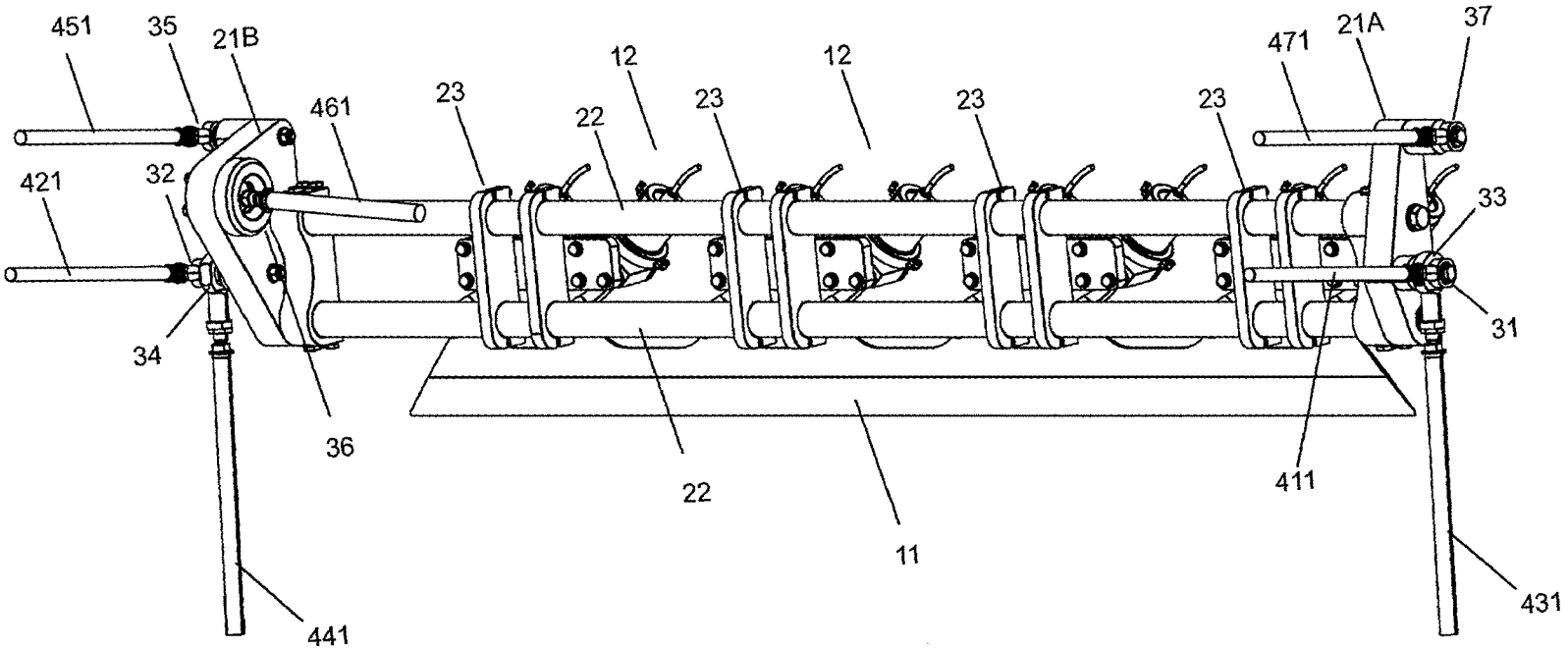
Figure 3A:
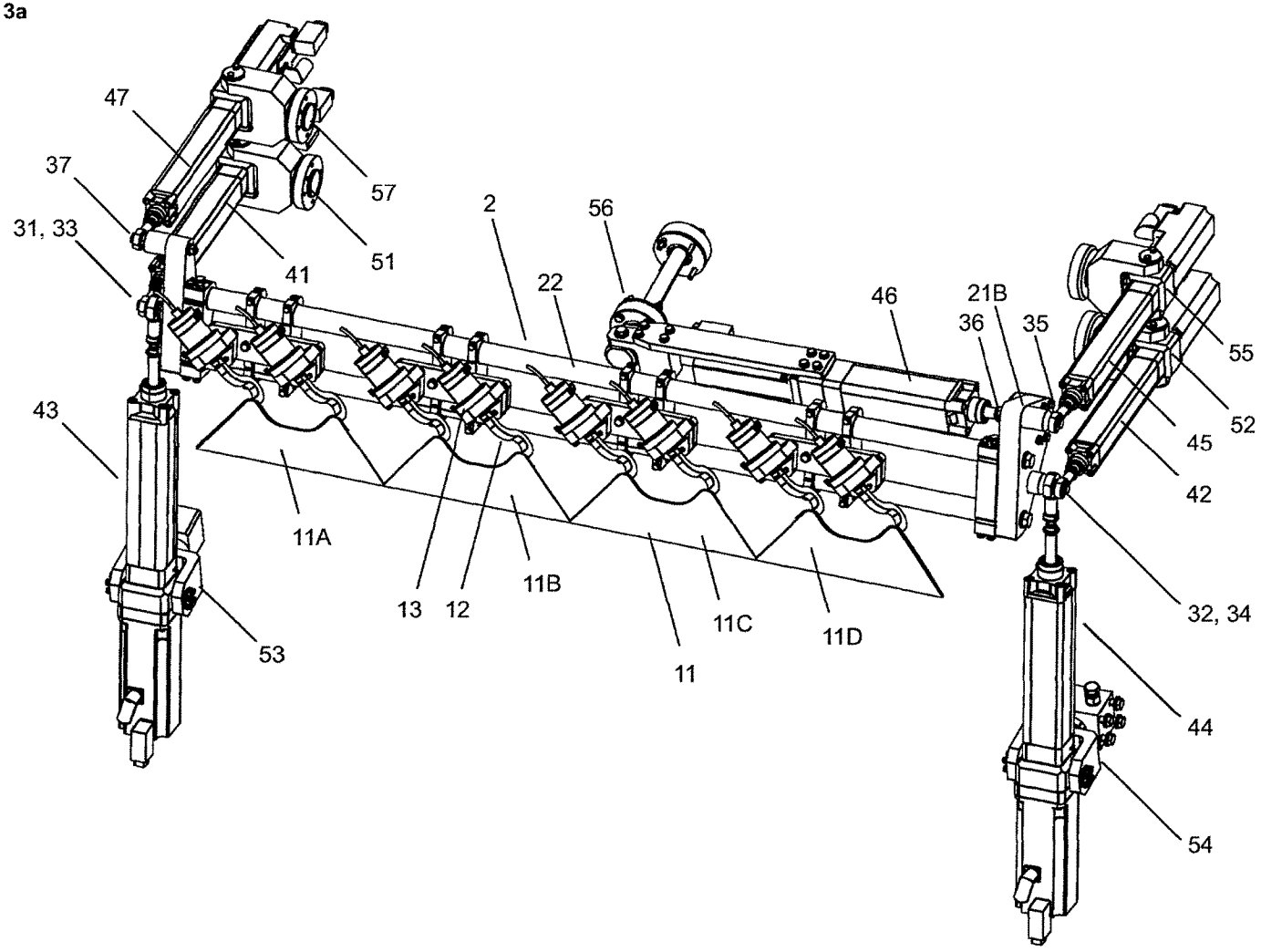
Figure 3B:
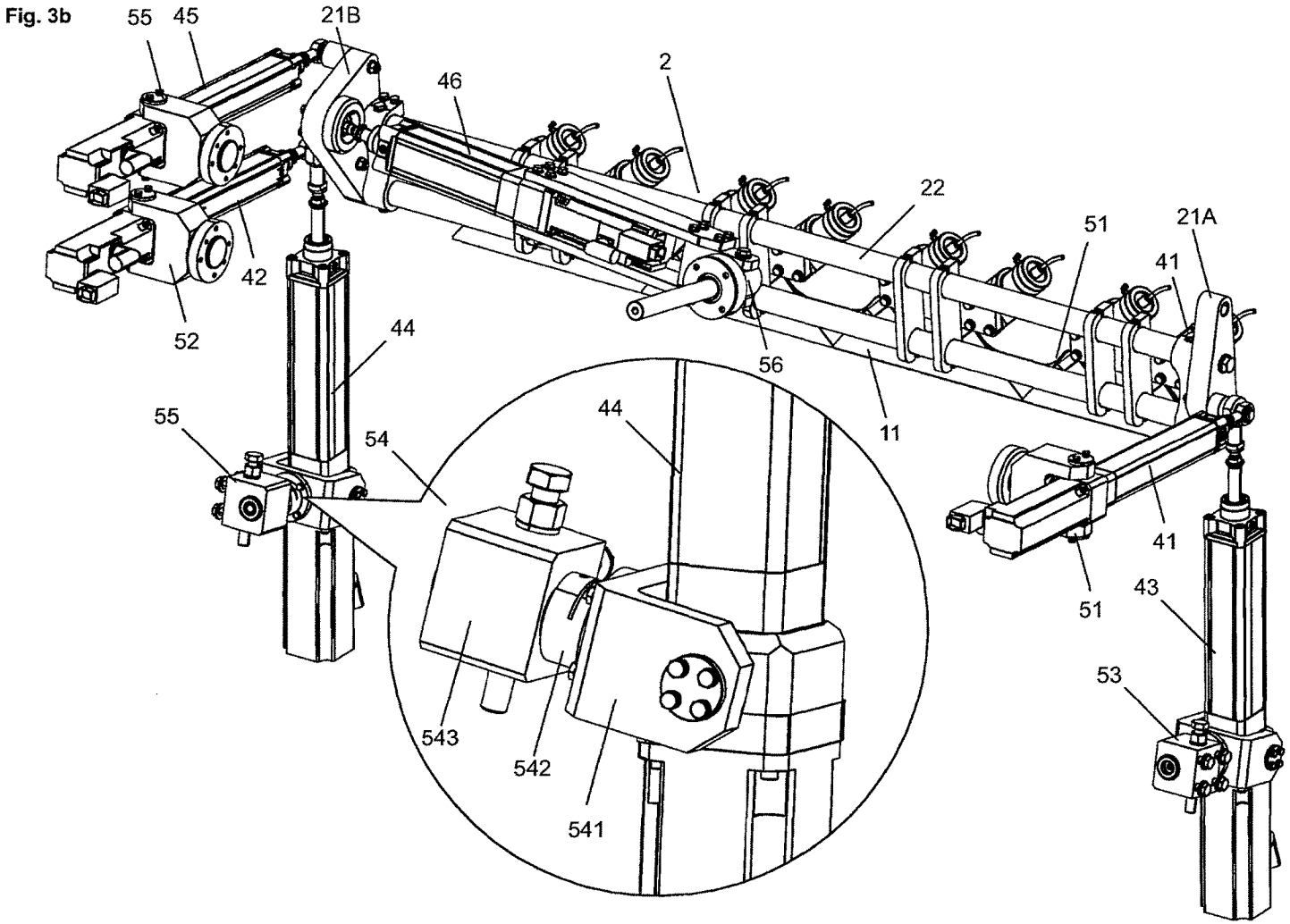
Figure 4:
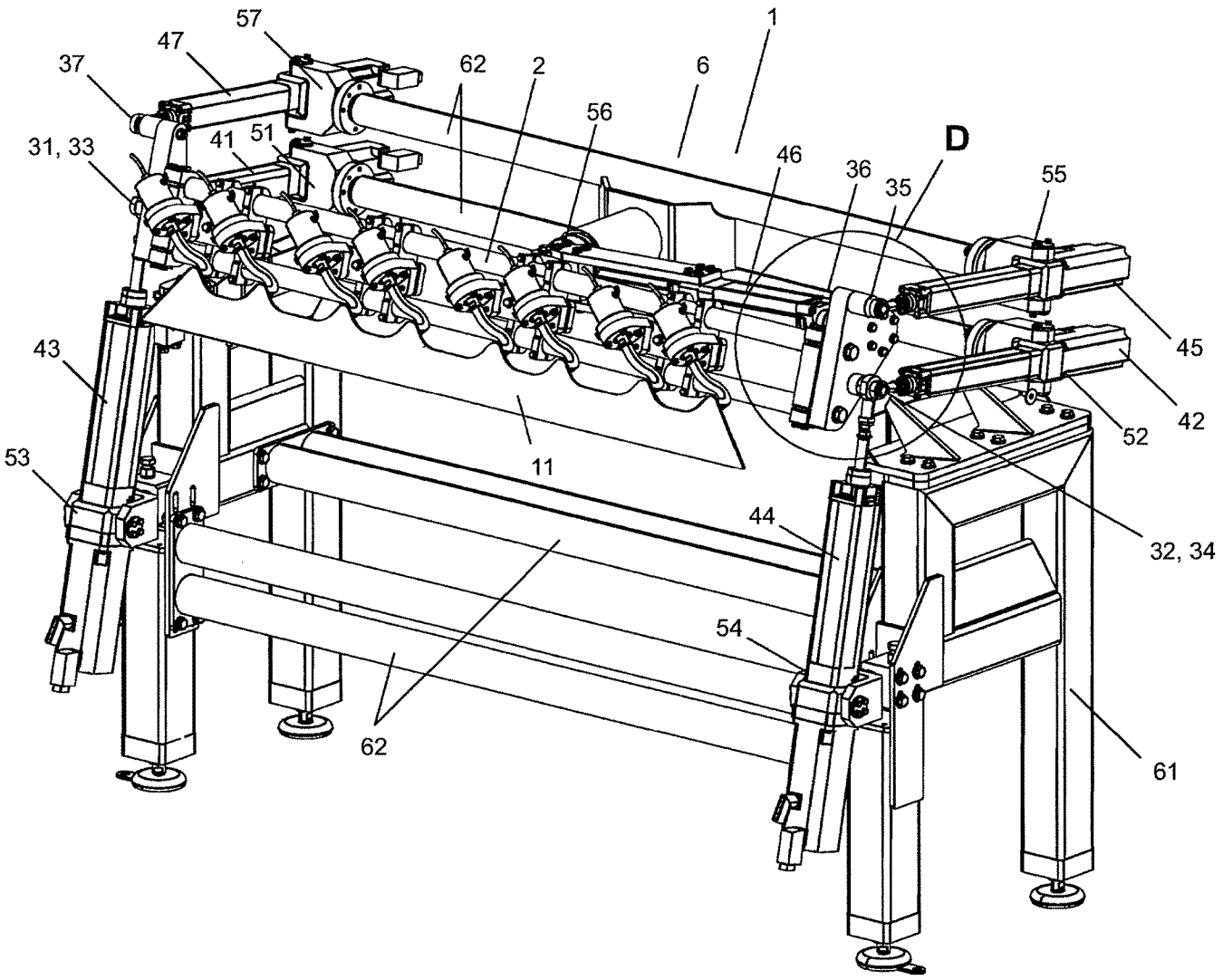
Figure 5:
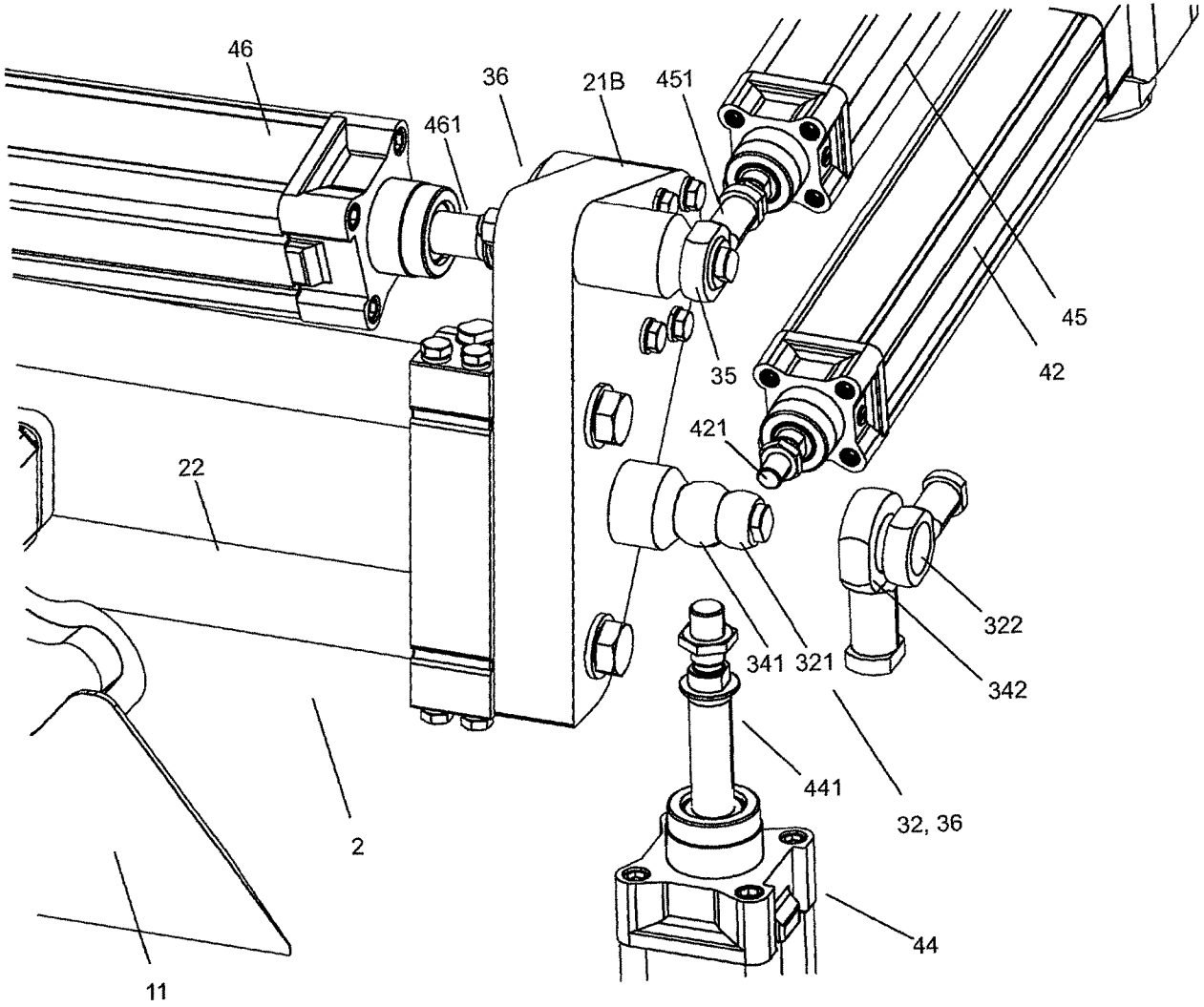

Below the invention is described in detail with reference to the drawings. Thereby show:

FIG. 1 an inventive device 1, which serves for processing at least one product and which comprises thereto at least one blade 11 held by a blade holder 2, to which seven actuators 41, . . . , 47 are coupled, which are pivotally connected to a framework 6 and by which the blade 11 can execute almost any movements within a volume of operation in order to process, particularly cut or atomise the product;

FIG. 2*a* a symbolically shown drive device 4 as well as the blade holder 2 of FIG. 1, which comprises two side plates 21A, 21B, to which the piston rods 411, . . . , 471 of the actuators 41, . . . , 47 are coupled via first rotary joints 31, . . . , 37 and which are connected with one another by crossbars 22, which hold eight energy converters 13 that are connected via coupling members 12 to a unitary blade 11;

FIG. 2*b* the blade holder 2 of FIG. 2*a* from the back side;

FIG. 3*a* the blade holder 2 of FIG. 2*a*, which is connected to four blades 11A, 11B, 11C, 11D, and that is connected via the first rotary joints 31, . . . , 37 to the actuators 41, . . . , 47, which are held by second rotary joints 51, . . . , 57;

FIG. 3*b* the blade holder 2 of FIG. 3*a* from the back side with only six actuators 41, . . . , 46 as well as a detailed view of the second rotary joint 54 that is connected to the fourth actuator 44;

FIG. 4 the inventive device 1 of FIG. 1 with the framework 6 as well as the blade holder 2 and the actuators 41, . . . , 47 of FIG. 1; and FIG. 5 section D of the inventive device 1 shown in FIG. 4 with the four actuators 42, 44, 45 and 46 connected to the right side plate 21B of the blade holder 2.

FIG. 1 shows an inventive device 1, which serves for processing a product or a plurality of products that are conveyed to the device 1, e.g. on different planes and from different directions. Device 1 comprises at least one blade 11 that is supplied with ultrasonic energy and that is held by a blade holder 2. In this embodiment, the blade holder 2 is pivotally coupled with seven actuators 41, . . . , 47, which in addition thereto are pivotally connected to a framework 2 and held by the framework 2. The actuators 41, . . . , 47 are preferably linear drives comprising a piston rod, that is driven by an electric motor and that can be driven out and back stepwise. Hence, by means of the piston rods the blade 11 can execute almost any movements within a volume of operation, in order to process, particularly cut or atomise a processed product. The motion-sequences, which are programmed and controlled by a control unit 7, are dependent from the number of installed actuators, whose control sequences are coordinated. The control unit 7, which is held by a swivel arm, preferably comprises a screen or touch-screen, via which commands can be entered, in order to select pre-programmed motion-sequences or in order to define new motion-sequences of the blade 11.

The programming of the device 1 can be done different ways. E.g., the blade 11 can be guided along a desired cutting area, whereby the motion-sequences of the piston rods are measured and registered. Furthermore, curved areas in a geometrical space can be defined, based on which the positions of the first swivel joints are determined and the course of the distances between the first and second swivel joints corresponding to one another are identified. The actuators 41, . . . , 47, particularly the seventh actuator 47, which can axially move the blade, can also execute oscillating movements.

FIG. 1 shows that the device 1 comprises a relatively long unitary (see FIG. 2*a*) or multipart (see FIG. 3*a*) blade 11, which can be moved within a relative large volume of operation that is determined by the length of the piston rods of the actuators 41, . . . , 47. Preferably a unitary blade 11 is used. In spite of the large dimensions of the blade 11 and of the large volume of operation as well as the manifold applicability, if appropriate including processing a plurality of products, the invention allows the setup of the device 1 with spatial dimensions that essentially depend on the size of the blade 11. The columnar actuators 41, . . . , 47 can be arranged in parallel to members of the framework or rack 6 and do not substantially increase its dimensions.

The device 1 further comprises protection covers and a hood 65, which can be moved backwards and turned upwards.

FIG. 2*a* symbolically shows a drive device 4 consisting of the actuators 41, . . . , 47 as well as the blade holder 2 of FIG. 1 with a unitary blade 11. The blade holder 2 comprises two side plates 21A, 21B, to which the piston rods 411, . . . , 471 of the actuators 41, . . . , 47 are coupled via first rotary joints 31, . . . , 37. The side plates 21A, 21B are connected with one another by two crossbars 22, on which eight energy converters 13 are mounted pairwise by means of four mounting devices 23. The energy converters 13 are connected via coupling members 12 to the unitary blade 11. The coupling members 12 comprise each a semi-circular bow, which stands perpendicular on the blade back of the blade 11 and is welded thereto. The coupling members 12 are arranged in an even pattern, whereby it is assured, that the ultrasound energy provided to the energy converters 13 by an ultrasound generator is evenly coupled into the blade 11. Hence, the blade 11 is held by eight coupling members 12, via which ultrasound energy is supplied as well.

In order to better display the blade 11 and the blade holder 2, the actuators 41, . . . , 47 are symbolically shown integrated in a block, i.e. the drive device 4. Shown are only the piston rods 411, . . . , 471 of the actuators 41, . . . , 47, which are coupled via the first rotary joints 31, . . . , 37 to the side plates 21A, 21B of the blade holder 2. The first rotary joints 31, . . . , 37 are preferably swivel joints, wherefore the piston rods 411, . . . , 471 are turnable within an aperture angle. By maximally deflecting and turning the piston rods 411, . . . , 471 around the related aperture angle, the piston rods 411, . . . , 471 move along the surface of a cone. Thereby, the aperture angle can be selected very large and can exceed 180° in specific sectors. Individual ones of the piston rods 411, . . . , 471 can travel by specific movements of the blade 11 through angle areas, which are different in size. In addition, aperture angles with different sizes can be assigned to individual ones of the rotary joints 31, . . . , 37. It is essential that the blade 11 can be moved and turned to a required degree within the desired volume of operation. FIG. 2*a* shows further that individual ones of the first rotary joints 31 and 33 or 32 and 34 can also be arranged immediately adjacent to one another, so that the related actuators 41, 43 or 42, 44 are coupled practically to identical points at the blade holder 2.

In FIG. 2*a* the basic movements, the translations V1, V2, V3, V4, V5 and the turnings D1, D2, D3, are drawn, which can be executed by the blade 11 individually or in combination.

By means of the first and the second piston rods 411, 421, which are aligned horizontally and in parallel to one another and which are coupled each to one side of the blade holder 2, the left side and the right side of the blade 11 can be displaced forth and back independently from one another or in combination equally (V1=V2) or un-equally (V1≠V2), optionally in opposite directions. With different movements of the piston rods 411, 421, a rotational movement D1 of the blade 11 can be achieved.

With the third and fourth piston rods 431, 441, which are aligned in parallel to one another and which are coupled each to one side of the blade holder 2 (at the same positions as the first and the second piston rods 411, 421), the left side and the right side of the blade 11 can be displaced independently from one another or in combination equally (V3=V4) or un-equally (V3≠V4), optionally in opposite directions, downwards and upwards, whereby rotational movement D2 can be achieved.

In order to avoid turning of the blade 11 when operating the first two actuators 41, 42, preferably a fifth actuator 45 is provided, which is aligned in parallel to the first and to the second actuator 41, 42 and is connected via a corresponding one of the first rotary joints 35 eccentrically to the blade holder 2. If the fifth actuator 45 is controlled identically to the first and the second actuator 41, 42, then a parallel translation of the blade 11 results forth and back. If the fifth actuator 45 is controlled differently, then a turning D3 around an axis results, which is defined by the coupling points of the first two actuators 41, 42. By turning D3 of the blade 11 a cut can be executed. Alternatively, the blade 11 can be aligned horizontally and held stably, so that a powdery product can be placed thereon, which then is atomised under the impact of ultrasound energy.

By operating the sixth piston rod 461, which is aligned almost in parallel to the blade 11, a lateral displacement (V5) of the blade 11, e.g. along its longitudinal axis can be executed. Thereby a vertical cut in combination with a horizontal cut can be executed, whereby even most difficult products can precisely be cut. A laterally acting oscillation can be superimposed on the vertical movement, so that the cutting process is facilitated.

FIG. 2*b* shows the blade holder 2 from the backside with the two side plates 21A, 21B and the two crossbars 22 and the four mounting devices 23 of FIG. 2*a* connected thereto, with which the energy converter 12 and the thereto connected blade 11 are held.

FIG. 3*a* shows the blade holder 2 of FIG. 2*a*, which is connected via the first rotary joints 31, . . . , 37 to the actuators 41, . . . , 47, which are held by second rotary joints 51, . . . , 57.

The blade holder 2 holds a multipart blade 11, i.e. four trapezoidal single blades 11A, 11B, 11C, 11D, which are axially aligned to one another in a plane and which form a common blade plane and a common blade edge. Alternatively, also eight for example triangular single blades can be used that are connected each to a coupling member 12.

The second rotary joints 51, . . . , 57, which in this embodiment comprise a rotational part and a hinge part and which exhibit therefore the function of a rotary joint and of a hinge joint combined, also allow the actuators 41, . . . , 47 to be moved within an aperture angle that is selected as required. The actuators 41, . . . , 47 are held on both sides by rotary joints 31, . . . , 37 and 51, . . . , 57 respectively. The alignment of the actuators 41, . . . , 47 is dependent from the deflection of each individual one of the actuators 41, . . . , 47 and the blade 11 is held practically flying, whereby a wing beat can actually be executed repetitively with the blade 11 within the volume of operation.

FIG. 3*b* shows the blade holder 2 from the backside with only six actuators 41, . . . , 46 and the related second rotary joints 51, . . . , 56 of FIG. 3*a* as well as a detailed view of the second rotary joint 54, which is connected to the fourth actuator 44. This second rotary joint 54 comprises a hinge joint 541, which holds the related fourth actuator 44 turnable in a first plane. The hinge joint 541 is pivotally held by means of an articulated shaft 542 and a joint bearing 543 turnable in a second plane, which extends perpendicular to the first plane. Hence, the fourth actuator 44 is held turnable within an aperture angle. This combined rotary joint or double joint 55 functionally corresponds to a swivel joint.

The seventh actuator 47 has been omitted in the embodiment of FIG. 3*b*, wherefore only the fifth actuator 45 acts eccentrically onto the second side plate 21B of the blade holder 2. The impact is not exerted symmetrically, which however does not lead to undesirable deformation or torsion of the blade holder. It must be noted that the product is divided by the blade 11, to which ultrasound energy is applied, practically without resistance. Hence, merely in preferred embodiments the seventh actuator 47 is provided, with which a symmetrical impact of force can be realised, if these would be desired.

FIG. 4 shows the inventive device 1 of FIG. 1 with the framework 6 as well as the blade holder 2 and the mounted actuators 41, . . . , 47 of FIG. 1. The framework 6 is set up in the manner of a table with legs 61 and crossbars 62, on which the actuators 41, . . . , 47 are fastened. The framework 6 can exhibit manifold designs and fulfils primarily the function of stably holding the actuators 41, . . . , 47. If a stable conveyor device is provided for processing a product or a plurality of products, then the second rotary joints can also be mounted on this conveyor device. In this way, the inventive device 1 can be integrated with minimum space requirement into a production line.

FIG. 5 shows section D of the inventive device 1 shown in FIG. 4 with the four actuators 42, 44, 45 and 46, which are connected via the corresponding first rotary joints or swivel joints 32, 34, 35 and 36 to the second side plate 21B of the blade holder 2. The two first swivel joints 32 and 34 are open, wherefore the joint balls 321, 341 and the joint sockets 322, 342, which are connectable to the piston rods 421, 441, are shown separated from one another. Hence, the second side plate 21B can be rotated and displaced as desired.

The invention claimed is:

1. A device for processing comprising:

at least one blade that is connectable via at least one coupling member and at least one energy converter to an ultrasound source and that is fastened to a blade holder, the blade holder being connected to a drive device held by a framework, the drive device including:

a plurality of actuators, the plurality of actuators including at least:

a first actuator and a third actuator each connected to a first side of the blade holder by a corresponding first rotary joint of a plurality of first rotary joints; and a second actuator and a fourth actuator each connected to a second side of the blade holder by a corresponding second rotary joint of a plurality of second rotary joints, the blade holder being held by actuators alone and displaceable along a transporting direction of a processed product or perpendicular to the transporting direction of the processed product.

2. The device according to claim 1, wherein the blade is rotatable around a longitudinal axis of the blade.

3. The device according to claim 1, wherein the blade includes a cutting edge on at least one side.

4. The device according to claim 1, further comprising a control unit with a control program configured to individually control the plurality of actuators such that the blade is guidable in alignment with at least one straight or curved cutting area.

5. The device according to claim 1, wherein the blade holder is rotatable around at least one axis perpendicular to a longitudinal axis of the blade.

6. The device according to claim 5, further comprising a fifth actuator that is aligned, inclined, or perpendicular to the longitudinal axis of the blade, the fifth actuator being connected to the second side of the blade holder by a corresponding first rotary joint of the plurality of first rotary joints, the blade being rotatable around the longitudinal axis of the blade or stabilized in a specific angle of rotation.

7. The device according to claim 6, wherein the fifth actuator is aligned in parallel with the first actuator and the second actuator.

8. The device according to claim 5, further comprising a sixth actuator that is parallel to the blade, the sixth actuator being connected to the second side of the blade holder by a corresponding first rotary joint of the plurality of first rotary joints, the blade being displaceable along the longitudinal axis of the blade.

9. The device according to claim 1, wherein at least some of the first rotary joints are swivel joints, hinge joints, fork joints, or angle joints.

10. The device according to claim 1, wherein at least one of the plurality of actuators include a controllable electric drive.

11. The device according to claim 1, wherein the blade holder includes two side plates which the plurality of actuators are coupled to, the two side plates being connected to each other by at least one crossbar, the at least one energy converter being mounted on the crossbar.

12. The device according to claim 11, further comprising a plurality of energy converters mounted on the at least one crossbar in pairs.

13. The device according to claim 1, wherein the at least one coupling member is curved and connected to a front side or a back side of the blade.

14. The device according to claim 13, further comprising a plurality of coupling members connected to the blade and evenly dispersed along a longitudinal axis of the blade, the blade being one integrated piece.

15. The device according to claim 1, wherein the first actuator and the third actuator are aligned perpendicular with each other.

16. The device according to claim 1, wherein the second actuator and the fourth actuator are aligned perpendicular with each other.

17. The device according to claim 1, wherein the blade is displaceable in three axes that are perpendicular to one another.

18. The device according to claim 1, wherein the plurality of actuators are linear drives including a piston rod.

19. The device according to claim 1, wherein at least some of the second rotary joints are swivel joints, hinge joints, fork joints, or angle joints.

20. The device according to claim 1, wherein at least one of the actuators are pneumatically driven.

21. The device according to claim 1, wherein the at least one coupling member is curved and welded to a front side or a back side of the blade.

* * * * *